US005888915A

United States Patent [19]

Denton et al.

[11] Patent Number: 5,888,915

[45] Date of Patent: Mar. 30, 1999

[54] PAPER MACHINE CLOTHINGS CONSTRUCTED OF INTERCONNECTED BICOMPONENT FIBERS

[75] Inventors: Jeffrey Scott Denton, Mendon; Dana Burton Eagles, Sherborn; Joseph Gerald O'Connor, Hopedale; Robert Bernard Davis, Framingham, all of Mass.

[73] Assignee: Albany International Corp., Albany, N.Y.

[21] Appl. No.: 714,856

[22] Filed: Sep. 17, 1996

[51] Int. Cl.[6] ..... D03D 15/00

[52] U.S. Cl. ..... 442/200; 139/383 A; 162/DIG. 902; 442/311

[58] Field of Search ..... 442/200, 311; 139/383 A; 162/DIG. 902

[56] References Cited

U.S. PATENT DOCUMENTS

| | | | |
|---|---|---|---|
| 4,731,281 | 3/1988 | Fleischer | 428/192 |
| 4,740,409 | 4/1988 | Lefhowitz | 428/131 |
| 5,077,116 | 12/1991 | Lefhowitz | 428/141 |
| 5,366,797 | 11/1994 | Rutgeri | 428/229 |
| 5,549,967 | 8/1996 | Gitrein | 428/229 |

FOREIGN PATENT DOCUMENTS 2097435 11/1982 United Kingdom .

*Primary Examiner*—James J. Bell
*Attorney, Agent, or Firm*—Kane, Dalsimer,Sullivan, Kurucz,Levy,Eisele and Richard, LLP

[57] ABSTRACT

The present invention is directed towards paper machine clothings comprised of interconnected bicomponent fibers. In one embodiment of the invention, the paper machine clothing is comprised entirely of bicomponent fibers in both the machine and cross machine direction. Advantage is taken of the unique bicomponent fiber structure, which permits selection of different materials for the sheath and core components. For instance, the sheath material may have a melting point lower than the melting point of the core material. Accordingly, a fused, bonded structure of bicomponent fibers can be formed where the sheath component has a melting point lower than the core component. By heating a fabric constructed of bicomponent fibers to a temperature greater than the melting point of the sheath component and lower than the melting point of the core component, with subsequent cooling of the fabric to below melt temperature of the sheath component, a fused, bonded structure will result.

5 Claims, 5 Drawing Sheets

PAPER MACHINE CLOTHINGS CONSTRUCTED OF INTERCONNECTED BICOMPONENT FIBERS

FIELD OF THE INVENTION

The invention disclosed herein is directed to the field of paper machine clothings.

BACKGROUND OF THE INVENTION

Paper machine clothing is the term for industrial fabrics used on paper machines in the forming, pressing and drying sections. They are generally fabricated with either polyester or polyamide multifilaments and/or monofilaments woven on conventional, large textile looms. These fabrics have been fabricated by conventional weaving techniques. The materials and processes, although an industry standard, have some inherent limitations described below.

The primary function of all paper machine clothing (PMC) is removal of water from the paper sheet. As both the manufacturer of paper machine builder and papermaker work to increase the speed of the papermaking process and improve paper quality, new barriers have been identified for PMC fabrics that demand innovation in materials and fabric design. Furthermore, the PMC manufacturer is also looking for more efficient production of PMC fabrics and enhancing key quality characteristics of the same.

Today, paper making machines are attaining such rapid speeds that the thickness of the fabric structure is beginning to limit the rate of water removal, especially in the forming section. Insufficient dewatering results in low sheet strength. Sheet strength is critical for transferring and maintaining sheet properties through the next, more aggressive stages of sheet dewatering. One possible solution is to lengthen the forming section of the machine, but this is rather expensive and therefore of limited viability. The other approach is for the PMC manufacturer to produce thinner fabrics, but in a weaving process the smallest possible dimensions are the combined diameters of the filaments used in the warp and shute directions. Criteria such as dimensional stability, fabric strength and fabric life result in a practical limit to the fineness of the filament diameter and thus the overall thickness of the fabric. In many PMC positions, a tradeoff of these properties is not feasible or practical, and in fact higher machine speeds actually require further enhancement of these properties.

PMC fabrics are also porous media that must effectively achieve fluid flow, that is, either water flow in forming and pressing or air flow in drying. The porosity of the fabrics can greatly affect sheet properties important in the forming and pressing sections of the paper machine. Channels for transport are formed by the open spaces or interstices, between the warp and shute yarns. Channels also exist between the filaments at the crossover points. The weaving process limits the geometry of the pores because the yarn filaments are orthogonal.

The surface topography of PMC fabrics contributes to the quality of the paper product. Efforts have been made to create a smoother contact surface with the paper sheet. However, surface smoothness of PMC woven fabrics is limited by the topography resulting from the weave pattern and the filament physical properties. In a woven fabric (or knitted fabric), smoothness is inherently limited by the knuckles formed at the cross-over point of intersecting yarns.

PMC fabrics require constant cleaning because of build-up materials from the paper furnish. Two mechanisms of fabric soiling have been identified. Mechanical bonding occurs when fine particles from the paper furnish are entrapped in the spaces existing between filaments in the fabric. This mechanical bonding is enhanced by the fine interstices created at the orthogonal cross over points in a woven fabric. Chemical bonding describes the adherence of fine particles that comprise the furnish to the fabric due to the existence of chemical affinities. This problem has been studied over many years of effort and results indicate that mechanical bonding is more important than chemical bonding overall. Decreasing permeability from particle build-up decreases the useful life of a fabric. High pressure showers have been employed to wash the fabrics, but the harsh abrasive environment these showers present also decreases the useful life of PMC fabrics.

PMC manufacturing technology could be improved by speeding the weaving process. In weaving, a warp is threaded through a heddle, and the weave pattern is created by raising and lowering the heddle position for each filament in the warp direction before the shute pick. This is a slow process due to its many steps. A practical production rate for typical forming, pressing or dryer loom is limited to 100 picks/minute.

A variety of forming fabrics based largely upon polyester monofilaments have been developed in the past few decades. The most advanced of these developments is a two-layer monofilament fabric in which the two fabric layers are held together via a binder monofilament. Commercially, this fabric is sold under the name Triotex® by Albany International Corp., Albany, N.Y. The binder monofilament is the only monofilament in the Triotex® structure that holds the two fabric layers together. The top fabric layer is usually a plain weave structure, which is designed for optimal paper sheet formation. The bottom fabric layer is designed for wear and typically has long floats in which the shute monofilament travels under three or more warp monofilaments. These long floats are used as an abrasive wear surface, which wears away before wear can occur to the warp monofilaments. The binder monofilament is a shute monofilament that mechanically holds the top and bottom fabric layers together by traveling over a warp monofilament in the top fabric layer and under a warp monofilament in the bottom fabric layer. Under running conditions, the bottom and top fabric layers move relative to each other. This relative movement leads to fatigue and wear of the binder monofilament due to repeated deflection back and forth within the structure. Eventually, the binder monofilament will fail and allow the top and bottom fabrics to separate from each other. This separation leads to product failure.

PMC press fabrics are constructed from woven base fabrics of monofilaments and multifilaments. A carded web of staple filaments is needled onto the base fabric, forming a construction capable of transporting water away from the forming sheet of paper. Needling can damage the monofilaments in the base fabric, weakening the fabric. Press fabrics are also prone to shedding, the release of the batt fibers from the felt. Shedding results in a contaminated paper sheet and shortens the useful life of the press fabric. Paper sheet rewetting is often a problem in press fabrics. Fluid removed from the sheet in the press nip can return to the sheet immediately after exiting the nip, reducing the overall efficiency of the pressing operation.

U.S. Pat. No. 4,740,409 discloses a nonwoven fabric having knuckle-free planar surfaces comprised of parallel linear machine direction yarns residing in a single plane and interconnecting, cross-machine direction polymeric material also residing in the plain, the cross machine direction material entirely surrounding the machine direction yarns. An array of side by side sheath core yarns are fed to machine direction grooves of a pinned roll section where they are forced into the grooves by heat and pressure. The sheath core monofilament cross section area is greater than the area of the machine direction groove so that excess sheath material is forced into cross direction grooves to form the cross directional interconnecting structure.

U.S. Pat. No. 5,077,116 discloses a forming fabric having a non-woven surface coating. The forming fabrics have a transverse nonwoven sheet contact layer adhered to the base fabric layer. The fluid flow passageways between adjacent structured members in the nonwoven sheet contact layer are smaller than the fluid flow passageways in the adjacent base fabric layer and are in fluid communication with the nonwoven sheet contact surface or the nonwoven surface adjacent the base fabric, or both. The nonwoven sheet contact layer may be comprised of bicomponent fibers having a polyester core and low melting temperature copolyester sheath. It is disclosed that these fibers could be adhered to each other and to the base fabric by fusion bonding means.

U.S. Pat. No. 5,366,797 discloses a bonded yarn bundle comprising at least one twisted multifilament yarn composed of a first synthetic polymer, whose individual filaments have become bonded together over essentially the entire thread cross-section by the melting of a second thermoplastic synthetic polymer whose melting point is at least 10° C. below the melting or decomposition point of the first synthetic polymer.

The yarn bundles comprised of a yarn of a first synthetic polymer is a meltable or nonmeltable polymer which provides a high strength characteristic. The yarn of a second synthetic polymer is a meltable material whose melting point is lower than the melting point of the first material.

GB 2 097 435 discloses a papermaker's fabric using yarns woven from high melting point monofilament or multifilament warp yarns and similar top and bottom weft yarns. Stiffer weft yarns in the center plane of the fabric are lower melting point synthetic yarns. The fabric is heated to a temperature to cause the low melt temperature stuffer yarns to melt and flow in a way that they fill voids in the weave pattern, reducing permeability.

U.S. Pat. No. 4,731,281 discloses a papermaker's fabric, woven from uniformly precoated, totally encapsulated monofilament yarns. The yarns are coated prior to the weaving of the papermaker's fabric in order to impart anti-sticking characteristics to the papermaker's fabric. The coatings may be such that thickness of the machine direction yarns is different than the thickness of the cross-machine direction yarns.

SUMMARY OF THE INVENTION

The present invention is directed towards paper machine clothings comprised of interconnected bicomponent fibers. In one embodiment of the invention, the paper machine clothing is comprised entirely of bicomponent fibers in both the machine and cross machine direction.

The paper machine clothings described herein can be of a woven, knitted, or nonwoven construction. It should be understood that the bicomponent fibers are arranged in an orderly manner.

In the present invention, bicomponent fibers are used in at least one, but not necessarily all, of the layers of a paper machine clothing. For example, bicomponent fibers may be the fibers which comprise the surface contacting layer of the clothing, which contacts the fibrous material that is being formed into paper or related product.

Advantage is taken of the unique bicomponent fiber structure, which permits selection of different materials for the sheath and core components. For instance, the sheath material may have a melting point lower than the melting point of the core material. Accordingly, a fused, bonded structure of bicomponent fibers can be formed where the sheath component has a melting point lower than the core component. By heating a fabric constructed of bicomponent fibers to a temperature greater than the melting point of the sheath component and lower than the melting point of the core component, with subsequent cooling of the fabric to below melt temperature of the sheath component, a fused, bonded structure will result.

Suitable bicomponent fibers include sheath-core combinations of co-polyester/poly(ethylene terephthalate), polyamide/poly (ethylene terephthalate), polyamide/polyamide, polyethylene/poly (ethylene terephthalate), polypropylene/poly(ethylene terephthalate), polyethylene/polyamide, polypropylene/polyamide, thermoplastic polyurethane/polyamide and thermoplastic polyurethane/poly(ethylene terephthalate).

In a preferred embodiment of the invention, bicomponent fibers are the sole constituent fiber of at least one layer of a clothing. In the case of multiple layer clothing, at least one layer is constructed of bicomponent fibers, which could be the surface layer in contact with the paper sheet or the base layer. Whether the fabric is a single layer or multiple layer, the bicomponent fibers are to be arranged in an orderly non-random manner. By arranged in an orderly non-random manner, it is meant that fibers of a clothing run in a first direction; the first direction fibers do not intersect with other fibers running in the first direction; and that fibers of the clothing run in a second direction; the second direction fibers do not intersect with other fibers running in the second direction; that fibers running in the first direction intersect with fibers running in the second direction, and vice versa. For instance, fibers arranged in the machine direction will not intersect with each other and that such fibers will intersect only with fibers running in the cross machine direction. It is preferred that the clothings of the present invention be constructed of fibers running in the machine or cross machine direction, but such clothings could be constructed of fibers which run in directions that are at angles to the machine and cross machine direction of a paper making machine.

The use of bicomponent filaments in paper machine clothings offer improvements in both function and structure that are unrealized in clothings constructed of conventional monofilaments. Dimensional stability of fabrics are improved by heat fusion at cross over points. Heat fusion also improves resistance to soiling. Fabric thickness is decreased, that is, fabrics are of a reduced caliber, attributable to the use of finer filaments and reduced thickness at cross over points. Reduced thickness at cross over points also improves the planarity of the fabric.

Bicomponent fibers also form unique pore geometries upon heat fusion. Unique shapes are available depending on the kinds of filaments used in constructing fabrics. Reduced marking of the paper sheet is also another improvement over fabrics of conventional monofilaments.

The improvements mentioned above are desired by paper makers, particularly since the speeds on paper making machines are increasing. These properties are related to drainage, which is of greater concern on high speed machines. Smoothness and printability are also related to drainage, and on high speed machines these considerations may be compromised. Bicomponent fibers may offer a suitable solution to the problem, since fabric thickness, among other things, is reduced.

The aforementioned improvement in planarity of the fabric results in reduced marking of the paper sheet. This is highly desired by the paper maker.

In a preferred embodiment of the present invention, the clothings are constructed of yarns comprised of bicomponent multifilaments. That is, the yarns are formed of at least two bicomponent filaments arranged as multifilaments. At the appropriate time, the side-by-side bicomponent monofilaments are heat fused in the manner previously described. Such heat fusing could occur prior to fabric formation, or it could occur after the fabric has been formed.

Such bicomponent multifilament yarns, after heat fusion, have at least two core components set within a matrix of sheath component material, which after heat fusion forms a substantially unitary sheath around at the least two core components. The individual sheaths that existed prior to heat fusion cannot be discerned, while the at least two core components are distinct from the sheath and are distinct from each other.

As noted, the core material remains as a distinct region or regions within the sheath or matrix material. A typical failure mechanism of monofilaments is fibrillation, stress failure along the orientation direction of the filament. After bonding, the sheath becomes an non-oriented matrix less prone to fibrillation. In addition, the continuous matrix surrounding the plurality of cores will dissipate the stresses that induce fibrillation. Should a core element fibrillate, the continuous matrix will act as a bonding agent protecting the integrity of the entire structure. Ideally, the minimum sheath content is 10% cross sectional area up to a maximum of 50%.

The paper machine clothings of the present invention may be formed in any conventionally known matter. For instance, the bicomponent fibers that comprise the clothings may be woven, or they may be knitted in any pattern or configuration known to the skilled artisan.

One of the advantages that paper machine clothings of the present invention are believed to possess over conventional clothings comprised of monofilaments is that when woven (or knitted), such clothings exhibit relatively planar, knuckle free surfaces after fusion. It can be readily appreciated that when fibers are woven (or knitted), knuckles are formed which diminishes surface smoothness. When the temperature exceeds the melt temperature of the sheath component during heat fusion of bicomponent fibers, knuckle size is reduced when material flows and collapses, improving the surface smoothness. Surface smoothness is a factor which affects paper quality. Accordingly, clothings of improved smoothness are of interest to the manufacturer of paper and related products. A network of bonds between intersecting fibers will be formed upon heat fusion of a clothing comprised of bicomponent fibers. Physical bonding of this kind will improve the dimensional stability over a conventional clothing constructed of monofilament.

When running on a paper making machine, a fabric according to the present invention should remain cleaner than a clothing comprised of conventional monofilaments. Heat fusion of a fabric comprised of bicomponent fibers are characterized in part by fused, intersecting yarns. In contrast, conventional monofilaments have interstices or pinch points, where yarns intersect. Fusion at the intersections of bicomponent fibers diminishes, and possibly eliminates, such pinch points, where debris could otherwise collect and become entrapped between yarns. Accordingly, the heat fused intersecting yarns produced with bicomponent fibers provides a structure that should remain relatively cleaner than a clothing comprised of conventional monofilaments.

DESCRIPTION OF THE PREFERRED EMBODIMENT

A simple bonded sheath/core structure was made from 250 denier yarns. This structure was made by fusing a plain weave prior to heat fusion. The final bonded structure of the clothing was relatively more planar than the unbonded fabric or a woven structure made from the same denier monofilament. A fused fabric woven from the sheath/core yarns will exhibit increased dimensional stability. After thermal bonding, each crossover point will become a welded joint in the fabric. Movement of the individual yarns will not be possible, and the fabric will move as a single unit. These welded crossover points also serve to eliminate frictional abrasion between the filaments. Physical bonding of this kind will improve the dimensional stability over a conventional clothing constructed of monofilament.

Several other advantages are also derived. Experiments show that the bonded fabric is significantly more resistant to high pressure shower damage than a woven structure. In a high pressure shower (HPS) test ring with a pressure of 3 MPa and a shower distance of 300 mm, the bonded fabric exhibited no damage after 180 minutes. The control fabric was damaged after 150 minutes. A bonded fabric after testing cannot be distinguished from the bonded fabric prior to testing. Secondly, for the same basis weight and weave pattern, abrasion resistance of the bonded structure is higher, since a greater surface area is in contact with the wear surface. In the woven fabric, the wear surface is the limited areas of high points of the exposed shute and warp filaments. Thermally bonded sheath/core filaments lead to structures with curved, smooth crossover points. Contamination of the fabric by mechanical bonding is minimal with the reduction of the interstitial space between the filaments as the crossover points.

While clothings of the present invention may be constructed of woven or knitted bicomponent fibers, it is not a necessary step in fabric formation, since the fibers of the clothing can be arranged in an intersecting pattern and then heat fused in order to affix the yarns of the clothing substantially in place.

Figure 1:
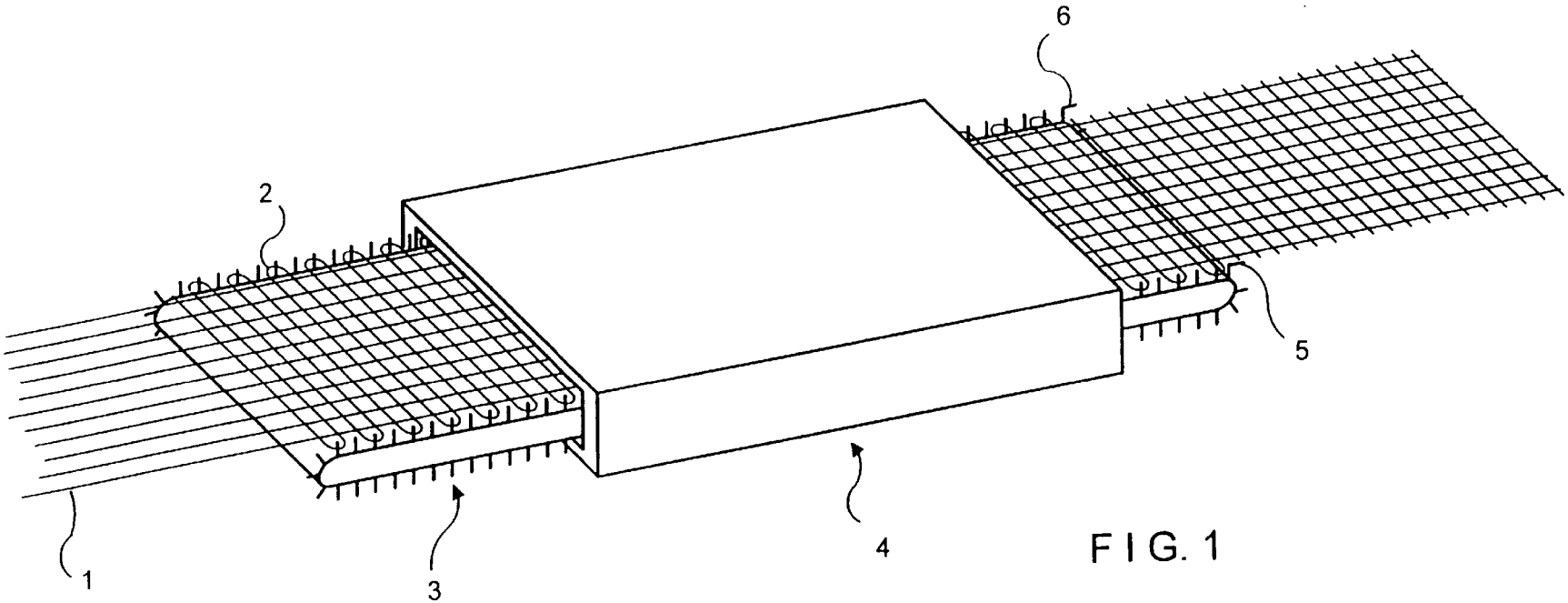
FIG. 1 is a view of a method of making the present invention.

Conventional weaving or knitting is not precluded in constructing clothings from these yarns, but other methods are possible. One process of making a fabric involves producing a warp, laying a second layer of shute direction yarns directly over the warp without weaving and passing the layered filaments through a heated zone at or above the melting point of the sheath material with or without applied pressure to bond at all the crossover points such as depicted in FIG. 1. This would be a faster manufacturing process to make very close spaced pore fabrics, such as those required for the first dryer fabric position in the papermaking process.

Figure 2A:
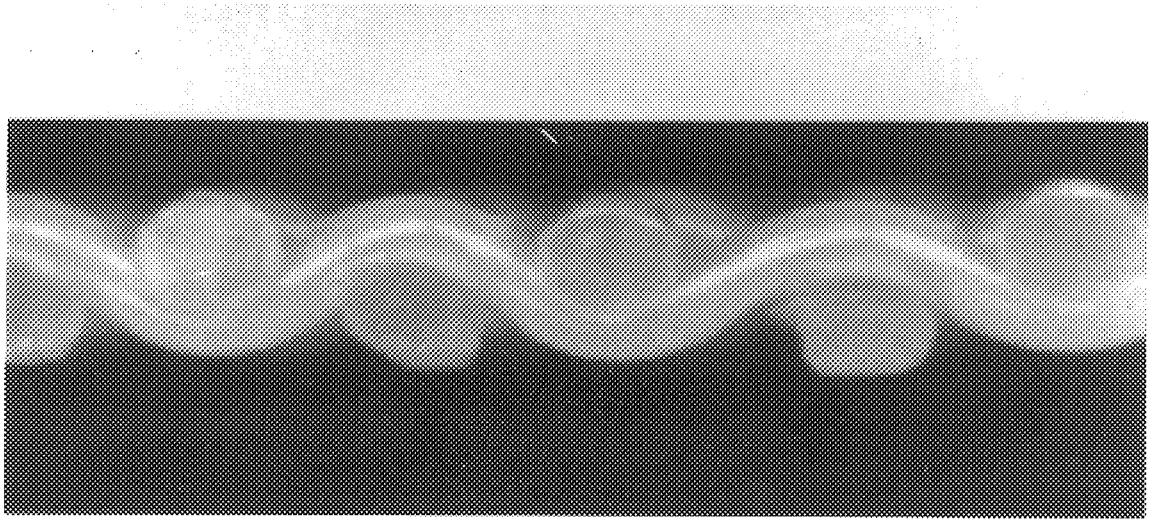
FIGS. 2*a*–2*c* are representative of the prior art.
Figure 2B:
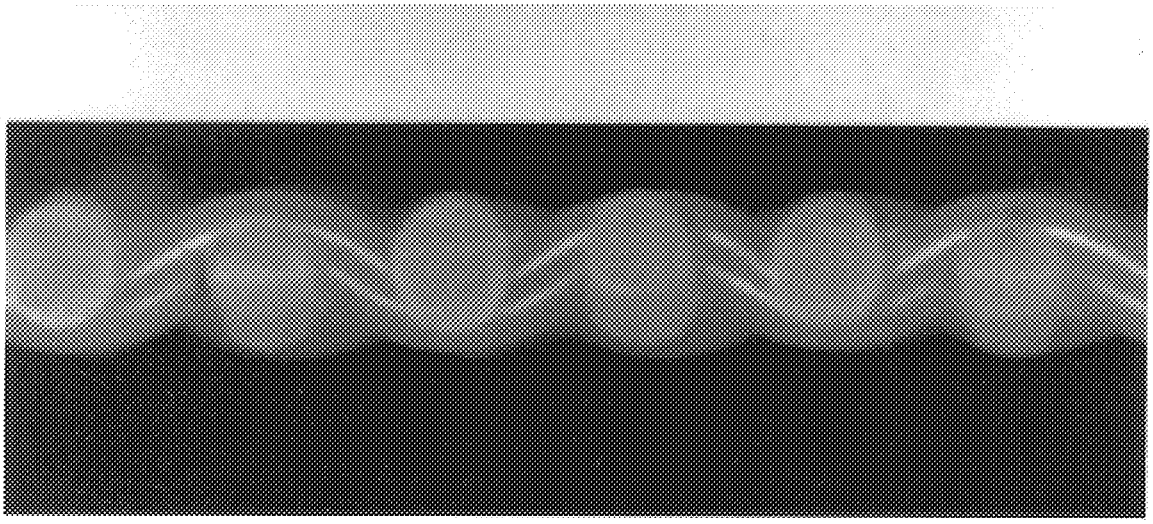
Figure 3A:
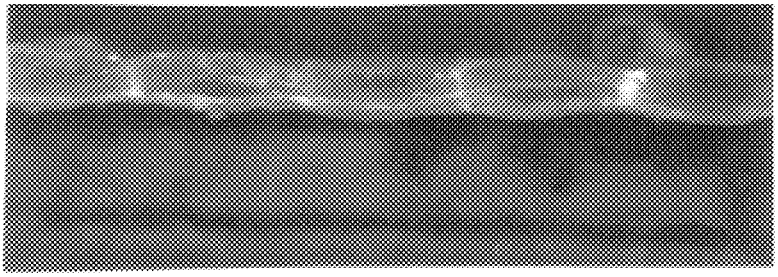
FIGS. 3*a*–3*b* are side views of one aspect of the present invention.
Figure 3B:
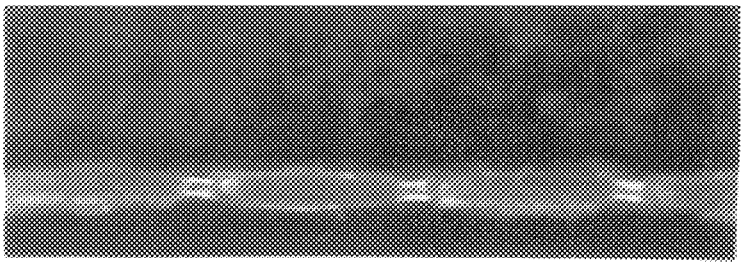

FIGS. 2*a* and 2*b* show cross sections of a layer of a triple layer fabrics woven from conventional monofilament. Caliper of the monofilament plain weave is 0.116 inch. FIGS. 3*a* and 3*b* show the caliper of a similarly woven layer of bicomponent monofilaments. Caliper is 0.070 inch.

Figure 2C:
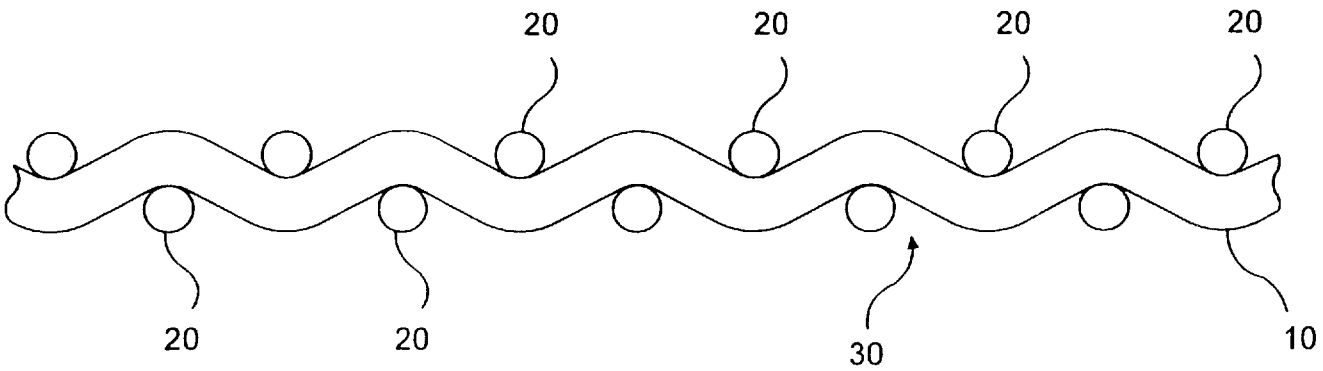

FIG. 2*c* is a computer generated model of the machine direction monofilament contour shown in FIG. 2*a*. In the model, there are 3 variables: caliper, plane difference, and compression of the warp and shute. The objective was to use the model to match the actual monofilament sample, so caliper was fixed at 0.0116" and plane difference was fixed at 0.0001" shute-high, leaving the compression variable as the only unknown. Examination of the contours in FIGS. 2*a*–2*b* revealed that more compression was present in the shute strand. Therefore, in the model level 5 was selected for the shute compression and level 0 for the warp compression. This yielded a model image that matched the actual cloth for:

caliper (0.0116")

plane difference (0.0001" shute high)

mesh×count (86×77)

diameters (0.15 mm MD and CD)

Using the same computer model and constraining strand density, with diameters and surface plane difference remained the same as the sample, compression was taken as high as possible (20%) to determine the thinnest possible caliper available to the paper maker. The limit of 20% compression was obtained from empirical studies here using PET warps and shutes. A caliper of 0.0095" was obtained. Thus the caliper of 0.0070" with the BIKE layer is unattainable with monofilament components of these diameters.

The bonded structure can be used as a top layer in a multilayer PMC product to take advantage of the thinner structure, greater abrasion and soil resistance, improved resistance to drain for high pressure showering and the unique pore structure.

Figure 4:
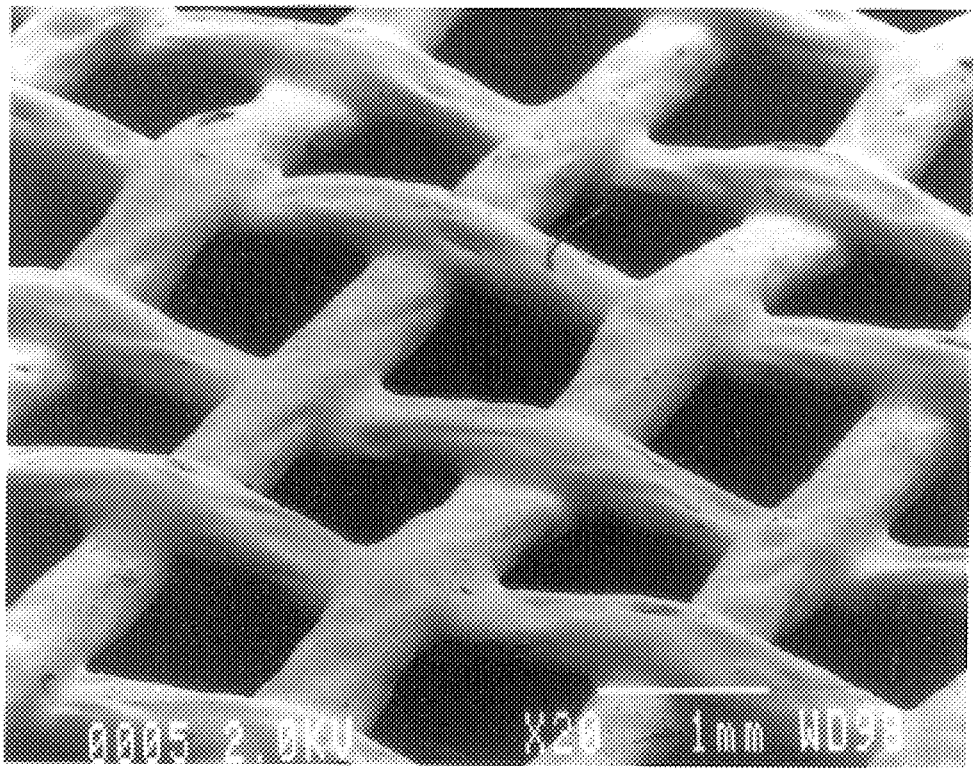
FIG. 4 is a top view of the present invention.

FIG. 4 shows a fabric of a plain weave construction, with yarns in the warp and shute directed being comprised of yarns wherein bicomponent fibers are braided around a Kevlar core. It can be observed from FIG. 4 that the yarns are interconnected with other yarns at the points at which the yarns intersect. This is attributable to the heat fusion of yarns, wherein the sheaths of the bicomponent materials fuse to each other after heating the fabric to a temperature above the melting point of the sheath material, yet lower than the melting point of the core material.

Both the warp and shute yarns of the fabric shown in FIG. 4 are of the same structure. The interior yarns are about 134 filaments of high modulus Kevlar 49. Around the Kevlar interior, eight bicomponent yarns are braided around the Kevlar interior. Each yarn is constituted of sixteen (16) bicomponent filaments. The filaments are a 250 denier, 16 filament count having a low melt copolyester sheath material and a poly(ethylene terephthalate) core, with the melting point of the copolyester sheath being lower than the melting point of the PET core, available as Bellcouple® from Kanebo.

The eight bicomponent yarns are braided around the Kevlar interior. Braiding forms a relatively stable structure, and the wrapped high modulus yarns can be used to form fabrics. Such fabrics are formed according to methods readily appreciated to one skilled in the art. After the fabric has been formed, it is placed under tension, heated to a temperature greater than the melting point of the sheath, yet lower than the melting point of the core, and then cooled to a temperature lower than the melting point of the sheath.

Because of the nature of fused covered bicomponent fibers and the unique structures they may form, fibers of denier lower than those for required for conventional monofilaments can be used. The use of lower denier fibers offers the advantage of a clothing thinner than a clothing comprised of conventional monofilament, without sacrificing fabric strength.

Because of the favorable characteristics attributable to high modulus materials like Kevlar, it is possible to construct fabrics that possess the same degree of strength, or an even greater degree of strength, than fabrics constructed of conventional materials while employing less material in fabric construction. That is, the fabrics of the present invention possess greater than or equal strength on a weight basis.

Figure 5:
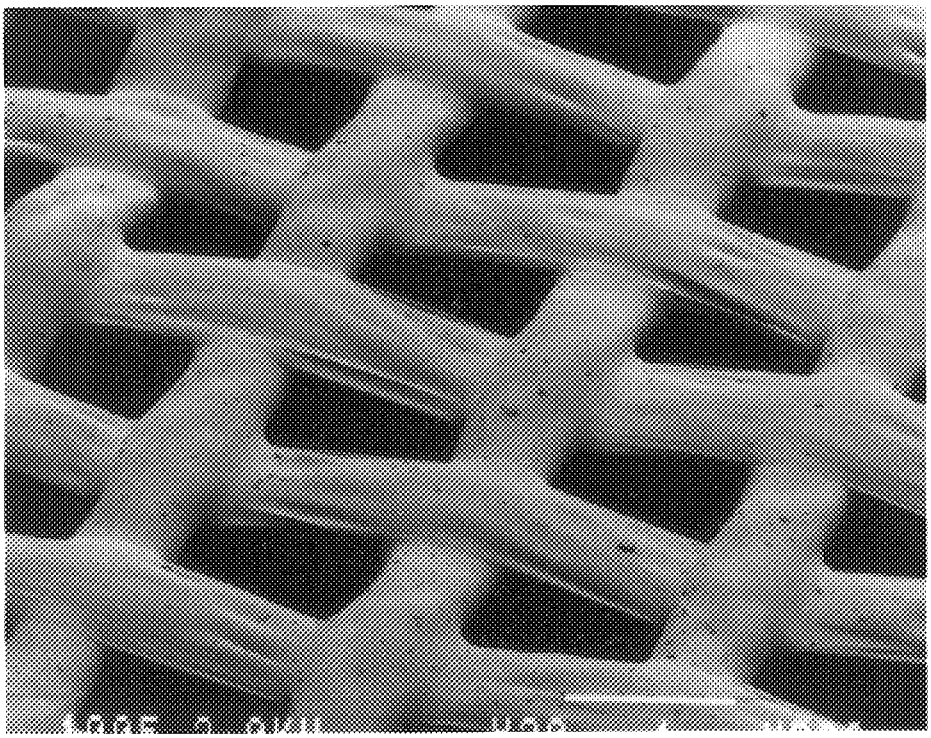
FIG. 5 is a top view of the present invention.

FIG. 5 shows a fabric wherein the yarns described in relation to FIG. 4 above are used in the warp direction. The shute direction yarns are comprised of 9 ply material. That is, they are a ply of nine yarns of bicomponent material as described in FIG. 4. The plied yarns are twisted loosely together. The yarns have a distinctly flattened appearance. That is, after heat fusion, the yarns take on a ribbon like appearance.

Figure 6:
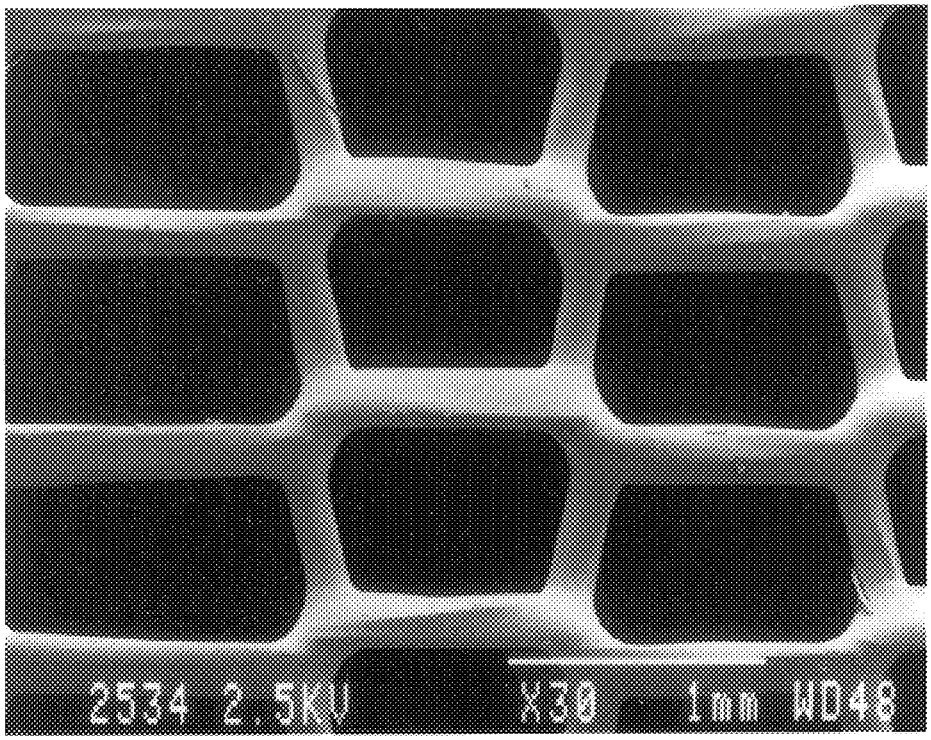
FIG. 6 is a top view of the present invention.

In addition, unique pores shapes are possible since individual filaments can be placed at oblique angles to the warp yarns. Another unique pore can result from using a knitted fabric of sheath/core filaments and subsequently bonding the structure as seen in FIG. 6. Again, this structure could be used as a top layer to a multi layer fabric for the unique pore shape with the other advantages cited for monoplanar fabrics.

The use of the sheath/core filaments in PMC press fabric add three benefits. Needle damage will be reduced. Needles can penetrate the yarn bundle with little damage to the bundle. Thus the batt fibers can be pushed through the yarns, and after bonding, the batt filaments will be essentially locked in place. Shedding of the batt fibers will decrease because of the thermal bonding. Capillary action may contribute to rewetting of the paper sheet after it emerges from the press nip. Water can be pushed forward along the warp fibers in the base fabric, and the water can return to the sheet after the nip. Thermal bonding of the base fabric will eliminate these paths for fluid travel. Water will be forced through the base fabric into the bottom web to be trapped and removed by vacuum techniques.

Several issues arise when discussing the effects of twist level in bicomponent yarns as the enter the loom. Yarns as processed contain little if any twist. If twist is present in as-shipped yarns, it is generally lost in the rewinding and warping operations. Untwisted yarns tend to fray and entangle as they progress through the loom. The entanglement results in shed that does not clear easily, so the manufactured fabric is woven by hand.

Twisted yarns will remain coherent bundles throughout the weaving process, avoiding the fraying and entangling problems and thus contributing to the overall weavability of the fabric.

Twisted structure has been shown to demonstrate higher breaking strengths when compared to flat yarns of the same nature, however, diminished returns are realized when the level of twist exceeds a critical value, beyond which the breaking strength actually decreases due to the axial orientation of the individual filaments and increased internal stresses. The strength of the yarns during the weaving process is of significance, and so the level of twist is of concern.

The level of twist can affect the overall nature of the fabric top surface. Fabrics woven with flat yarns were closed, that is, they lacked porosity, because the yarns flatten upon fusion into tape-like structures. A higher twist level will influence the roundness of the yarns in the finished structure. Twist level could control the porosity of the top laminate and that different fabrics could be manufactured simply by changing the degree of twist in the yarns. The geometry of the holes could be altered by the level of twist. Symmetrical twist in both the warp and shute directions will likely result in a square hole. Non symmetrical twist would likely result in a rectangular, elongated hole. Low levels of twist will result in a flatter fabric, and higher levels of twist will impart a texture to the surface, approaching the surface of a conventional fabric. Pore size can be changed without changing loom configuration. Pore geometry can be changed without changing loom configuration. Fabric surface characteristics can be changed using twist level.

We claim:

1. A paper machine clothing suitable for use in the forming, pressing, and drying sections of a paper machine comprised of a structure of intersecting and interconnected yarns, the yarns being comprised of a plurality of bicomponent monofilament fibers, said bicomponent monofilament fibers having a sheath component and a core component, wherein the sheath component is selected from a material having a melting point lower than the melting point of the core component, wherein the plurality of bicomponent monofilament fibers are heated to a temperature greater than the melting point of the sheath and lower than the melting point of the core, and the yarns are arranged in a first direction and a second direction in an orderly non-random intersecting pattern and said yarns are interconnected with each other.

2. The paper machine clothing of claim 1 wherein the yarns of the clothing are woven.

3. The paper machine clothing of claim 1 wherein the yarns of the clothing are knitted.

4. The paper machine clothing of claim 1 wherein the yarns of the clothing are arranged in a first machine direction and a second cross machine direction.

5. A paper machine clothing suitable for use in the forming, pressing, and drying sections of a paper machine comprised of a structure of intersecting and interconnected yarns, the yarns being comprised of a plurality of bicomponent monofilament fibers, said bicomponent monofilament fibers having a sheath component and a core component, wherein the sheath component is selected from a material having a melting point lower than the melting point of the core component, wherein the plurality of bicomponent monofilament fibers are heated to a temperature greater than the melting point of the sheath and lower than the melting point of the core, and the yarns are arranged in a first direction and a second direction in an orderly non-random intersecting pattern and said yarns are interconnected with each other, wherein said clothing when compared to clothing constructed of conventional monofilament, is relatively planar, smoother, thinner, exhibits improved soil resistance, exhibits improved dimensional stability, exhibits improved resistance to soiling, is less prone to fibrillation, exhibits improved abrasion resistance, and exhibits improved durability.

* * * * *